US009388987B2

(12) United States Patent
Valeev et al.

(10) Patent No.: US 9,388,987 B2
(45) Date of Patent: Jul. 12, 2016

(54) COMBUSTOR AND METHOD FOR SUPPLYING FUEL TO A COMBUSTOR

(75) Inventors: Almaz Kamilevich Valeev, Moscow (RU); James Harold Westmoreland, III, Greer, SC (US); Keith C. Belsom, Laurens, SC (US); John Alfred Simo, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 227 days.

(21) Appl. No.: 14/344,336

(22) PCT Filed: Sep. 22, 2011

(86) PCT No.: PCT/RU2011/000724

§ 371 (c)(1),
(2), (4) Date: Mar. 12, 2014

(87) PCT Pub. No.: WO2013/043076

PCT Pub. Date: Mar. 28, 2013

(65) Prior Publication Data

US 2014/0338359 A1 Nov. 20, 2014

(51) Int. Cl.
*F23R 3/34* (2006.01)
*F23L 7/00* (2006.01)
(Continued)

(52) U.S. Cl.
CPC ... *F23R 3/34* (2013.01); *F23L 7/00* (2013.01); *F23R 3/045* (2013.01); *F23R 3/346* (2013.01);
(Continued)

(58) Field of Classification Search
CPC ..... F23R 3/34; F23R 3/36; F23R 3/045; F23R 3/04; F23L 2900/07002
USPC ..... 60/733, 737, 740, 746, 748
See application file for complete search history.

(56) References Cited

U.S. PATENT DOCUMENTS 3,934,409 A 1/1976 Quillevere et al.
4,040,252 A 8/1977 Mosier et al.
(Continued)

FOREIGN PATENT DOCUMENTS

EP 0687864 A2 12/1995
EP 0924411 A2 6/1999
(Continued)

OTHER PUBLICATIONS

PCT Search Report and Written Opinion issued in connection with corresponding PCT Application No. PCT/RU2011/000724 on Feb. 21, 2013.
(Continued)

*Primary Examiner* — Steven Sutherland
(74) *Attorney, Agent, or Firm* — Dority & Manning, PA

(57) ABSTRACT

A combustor (10) includes a cap (16), a liner (20), a transition piece (24), and a combustion chamber (22) located downstream from the cap (16) and defined by the cap and liner. A secondary nozzle (40) circumferentially arranged around the liner (20) or transition piece (24) includes a center body, a fluid passage through the center body, a shroud circumferentially surrounding the center body, and an annular passage between the center body and the shroud. A method for supplying fuel to a combustor (10) includes flowing fuel through a primary nozzle radially disposed in a breech end of the combustor and flowing fuel through a secondary nozzle (40) circumferentially arranged around and passing through at least one of a liner (20) or a transition piece. The secondary nozzle (40) includes a center body, a fluid passage through the center body, a shroud circumferentially surrounding at least a portion of the center body (44), and an annular passage between the center body and the shroud.

11 Claims, 3 Drawing Sheets

(51) Int. Cl.
*F23R 3/04* (2006.01)
*F23R 3/36* (2006.01)

(52) U.S. Cl.
CPC ..... *F23R 3/36* (2013.01); *F23L 2900/07002* (2013.01); *F23L 2900/07008* (2013.01); *F23L 2900/07009* (2013.01)

(56) References Cited

U.S. PATENT DOCUMENTS

| | | | | |
|---|---|---|---|---|
| 4,045,956 | A | 9/1977 | Markowski et al. | |
| 4,112,676 | A | 9/1978 | DeCorso | |
| 4,253,301 | A | 3/1981 | Vogt | |
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,450,725 | A | 9/1995 | Takahara et al. | |
| 5,490,380 | A * | 2/1996 | Marshall | F23R 3/50 60/733 |
| 5,687,571 | A * | 11/1997 | Althaus | F23C 5/00 60/737 |
| 5,749,219 | A | 5/1998 | DuBell | |
| 5,974,781 | A | 11/1999 | Correa et al. | |
| 6,047,550 | A | 4/2000 | Beebe | |
| 6,178,737 | B1 | 1/2001 | Lenertz et al. | |
| 6,253,538 | B1 | 7/2001 | Sampath et al. | |
| 6,298,667 | B1 | 10/2001 | Glynn et al. | |
| 6,530,223 | B1 * | 3/2003 | Dodds | F23R 3/343 60/39.826 |
| 6,571,560 | B2 * | 6/2003 | Tatsumi | F23R 3/60 60/753 |
| 6,868,676 | B1 | 3/2005 | Haynes | |
| 6,925,809 | B2 | 8/2005 | Mowill | |
| 7,665,309 | B2 | 2/2010 | Parker et al. | |
| 8,689,559 | B2 | 4/2014 | Kraemer et al. | |
| 2002/0069645 | A1 | 6/2002 | Mowill | |
| 2007/0089419 | A1 * | 4/2007 | Matsumoto | F23R 3/06 60/737 |
| 2009/0084082 | A1 | 4/2009 | Martin et al. | |
| 2010/0174466 | A1 | 7/2010 | Davis, Jr. et al. | |
| 2011/0067402 | A1 * | 3/2011 | Wiebe | F23R 3/08 60/740 |
| 2011/0131998 | A1 | 6/2011 | Nadkarni et al. | |
| 2011/0179803 | A1 | 7/2011 | Berry et al. | |

FOREIGN PATENT DOCUMENTS

| | | | |
|---|---|---|---|
| EP | 1777459 | A2 | 4/2007 |
| EP | 2236935 | A2 | 10/2010 |
| JP | 2006010193 | A | 1/2006 |
| JP | 2006138566 | | 6/2006 |
| JP | 2010236550 | A | 10/2010 |

OTHER PUBLICATIONS

Unofficial English translation of Japanese Office Action issued in connection with corresponding JP Application No. 2014-531757 on Sep. 1, 2015.

* cited by examiner

COMBUSTOR AND METHOD FOR SUPPLYING FUEL TO A COMBUSTOR

FIELD OF THE INVENTION

The present invention generally involves a combustor and method for supplying fuel to the combustor.

BACKGROUND OF THE INVENTION

Commercial gas turbines are known in the art for generating power. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

The combustion gases exiting the turbine include varying amounts of nitrous oxides, carbon monoxide, unburned hydrocarbons, and other undesirable emissions, with the actual amount of each emission dependent on design and operating parameters. For example, the design length of the combustor directly effects the amount of time that the fuel-air mixture remains in the combustor. A longer residence time of the fuel-air mixture in the combustor generally increases the nitrous oxide levels, while a shorter residence time of the fuel-air mixture in the combustor generally increases the carbon monoxide and unburned hydrocarbon levels. Similarly, the operating level of the combustor directly influences the emissions content on the combustion gases. Specifically, higher combustion gas temperatures associated with higher power operations generally increase the nitrous oxide levels, while lower combustion gas temperatures associated with lower fuel-air mixtures and/or turndown operations generally increase the carbon monoxide and unburned hydrocarbon levels. Therefore, continued improvements in the combustor designs and methods for supplying fuel to the combustor would be useful to reducing undesirable emissions in the combustion gases.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a cap, a liner extending downstream from the cap, and a transition piece extending downstream from the liner. A combustion chamber is located downstream from the cap and at least partially defined by the cap and the liner. A secondary nozzle is circumferentially arranged around at least one of the liner or the transition piece. The secondary nozzle includes a center body that extends from a casing surrounding the combustor through at least one of the liner or the transition piece, a fluid passage through the center body, a shroud circumferentially surrounding at least a portion of the center body, and an annular passage between the center body and the shroud.

Another embodiment of the present invention is a combustor that includes a cap, a primary nozzle radially disposed in the cap, a liner extending downstream from the cap, a combustion chamber downstream from the cap and at least partially defined by the cap and the liner, and a transition piece extending downstream from the liner. A secondary nozzle is circumferentially arranged around and passes through at least one of the liner or the transition piece. The secondary nozzle includes a center body, a fluid passage through the center body, a shroud circumferentially surrounding at least a portion of the center body, and an annular passage between the center body and the shroud.

The present invention may also include a method for supplying fuel to a combustor that includes flowing a first fuel through a primary nozzle radially disposed in a breech end of the combustor and flowing a second fuel through a secondary nozzle circumferentially arranged around and passing through at least one of a liner or a transition piece. The secondary nozzle includes a center body, a fluid passage through the center body, a shroud circumferentially surrounding at least a portion of the center body, and an annular passage between the center body and the shroud.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
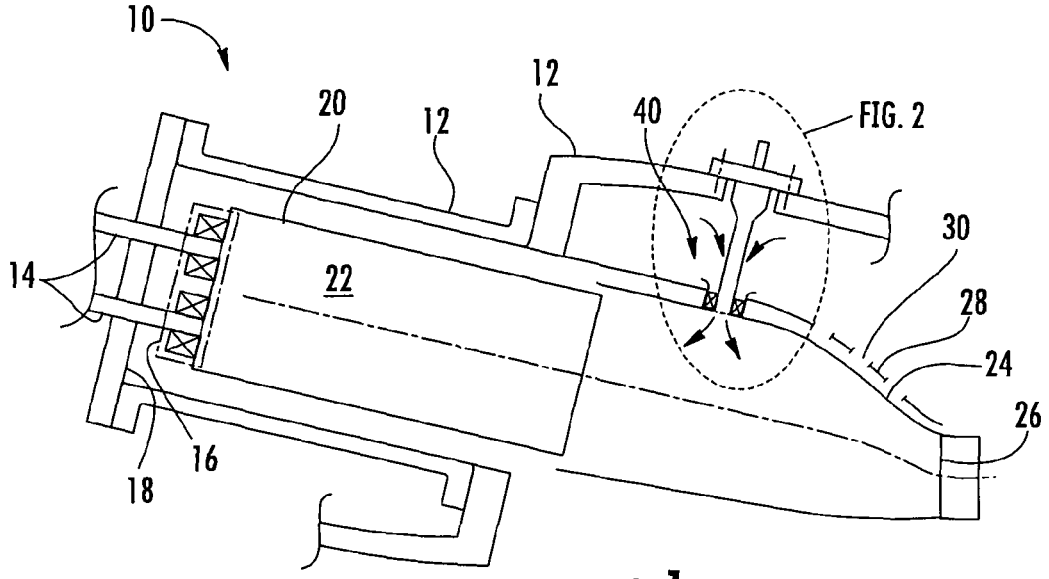
FIG. 1 is a simplified cross-section of an exemplary combustor according to a first embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor having primary and secondary nozzles. The primary nozzles may be located at a breech end of the combustor, and the secondary nozzles may be located peripherally around a combustion chamber. The primary and secondary nozzles provide a staged supply of fuel premixed with compressed working fluid to the combustion chamber to optimize the combustion gas temperature and residence time of the fuel in the combustor.

FIG. 1 provides a simplified cross-section of an exemplary combustor 10, such as may be included in a gas turbine, according to one embodiment of the present invention. A casing 12 may surround the combustor 10 to contain the compressed working fluid flowing to the combustor 10. As shown, the combustor 10 may include one or more primary nozzles 14 radially arranged in the breech end between a cap 16 and an end cover 18. The cap 16 and a liner 20 generally surround or define a combustion chamber 22 located downstream from the primary nozzles 14, and a transition piece 24 located downstream from the liner 20 connects the combustion chamber 22 to a turbine inlet 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

An impingement sleeve 28 with flow holes 30 may surround the transition piece 24 to define an annular plenum 32 between the impingement sleeve 28 and the transition piece 24. The compressed working fluid may pass through the flow holes 30 in the impingement sleeve 28 to flow through the annular plenum 32 to provide convective cooling to the transition piece 24 and/or liner 20. When the compressed working fluid reaches the end cover 18, the compressed working fluid reverses direction to flow through the primary nozzles 14 where it mixes with fuel before igniting in the combustion chamber 22 to produce combustion gases having a high temperature and pressure.

Figure 2:
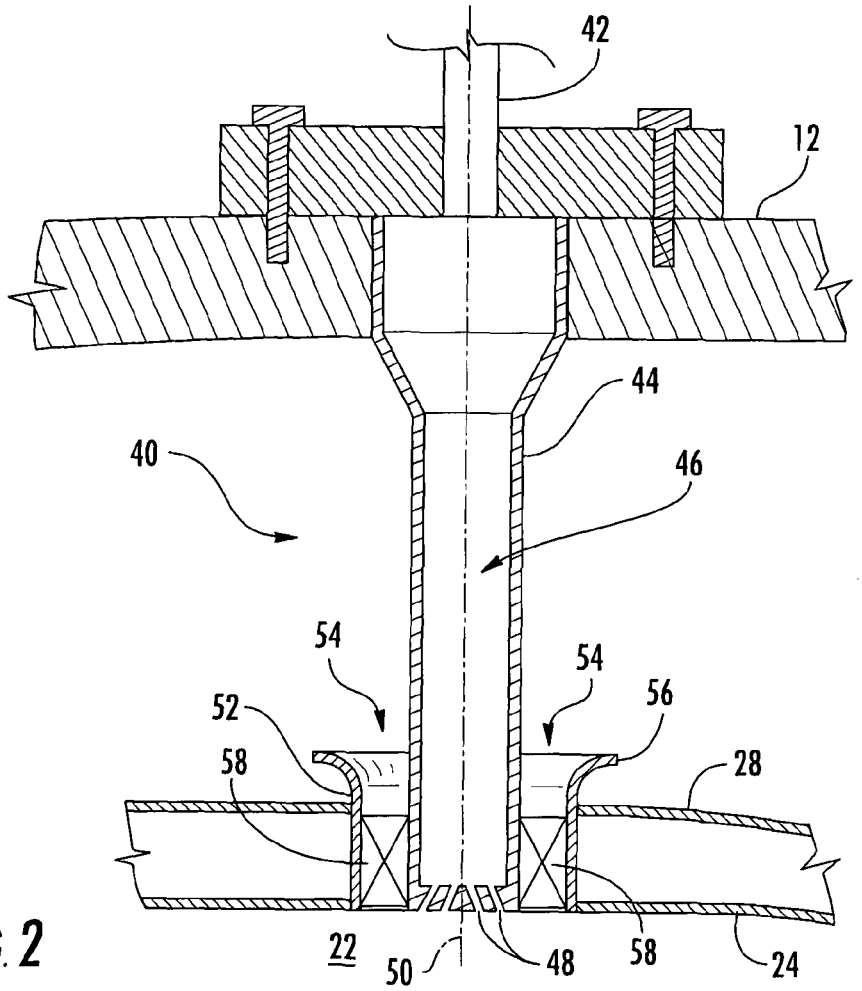
FIG. 2 is a enlarged view of an embodiment of a secondary nozzle shown in FIG. 1.

The combustor 10 further includes one or more secondary nozzles 40 circumferentially arranged around the combustion chamber 22 and aligned approximately perpendicular to the primary nozzles 14. In the embodiment shown in FIG. 1, the secondary nozzles 40 provide fluid communication through the transition piece 34 to the combustion chamber 22. FIG. 2 provides an enlarged view of one embodiment of the secondary nozzle 40 shown in FIG. 1. As shown, the secondary nozzle 40 may connect to a fluid manifold 42 located outside of the combustor 10. The fluid manifold 42 may supply fuel and/or a diluent through the secondary nozzle 40 to the combustion chamber 22. Possible liquid fuels supplied from the fluid manifold 42 through the secondary nozzle 40 may include light and heavy fuel oil, oil slurries, naptha, petroleum, coal tar, crude oil, and gasoline, and possible gaseous fuels supplied by the fluid manifold 42 through the secondary nozzle 40 may include blast furnace gas, carbon monoxide, coke oven gas, natural gas, methane, vaporized liquefied natural gas (LNG), hydrogen, syngas, butane, propane, and olefins. Possible diluents supplied from the fluid manifold 42 through the secondary nozzle 40 may include water, steam, fuel additives, various inert gases such as nitrogen, and/or various non-flammable gases such as carbon dioxide or combustion exhaust gases. The location of the fluid manifold 42 outside of the combustor 10 allows for ambient air to quickly dilute and dissipate any leaking fuel or diluent and facilitates the detection and repair of any leaks that may develop in the fluid manifold 42.

As shown most clearly in FIG. 2, the secondary nozzle 40 generally includes a center body 44 that defines a fluid passage 46 that extends from the casing 12 surrounding the combustor 10 through the transition piece 24. The fluid passage 46 may terminate at a plurality of ports 48 that provides fluid communication between the center body 42 and the combustion chamber 22. In particular embodiments, as shown in FIG. 2, the ports 48 may be angled with respect to an axial centerline 50 of the fluid passage 46 to impart swirl to the fluid flowing through the fluid passage 46 into the combustion chamber 22. In this manner, the center body 44, fluid passage 46, and ports 48 allow the introduction of fuel and/or diluents through the transition piece 24 to the combustion chamber 22 downstream from the primary nozzles 14.

The secondary nozzle 40 may further include a shroud 52 that circumferentially surrounds at least a portion of the center body 44 to define an annular passage 54 between the center body 44 and the shroud 52. The shroud 52 may further include a bellmouth opening 56 around at least a portion of the shroud 52 to facilitate the introduction of the compressed working fluid into and through the secondary nozzle 40. Alternately, or in addition, the secondary nozzle 40 may include one or more swirler vanes 58 in the annular passage 54 to impart a tangential swirl to the compressed working fluid flowing through the annular passage 54 and into the combustion chamber 22.

Figure 3:
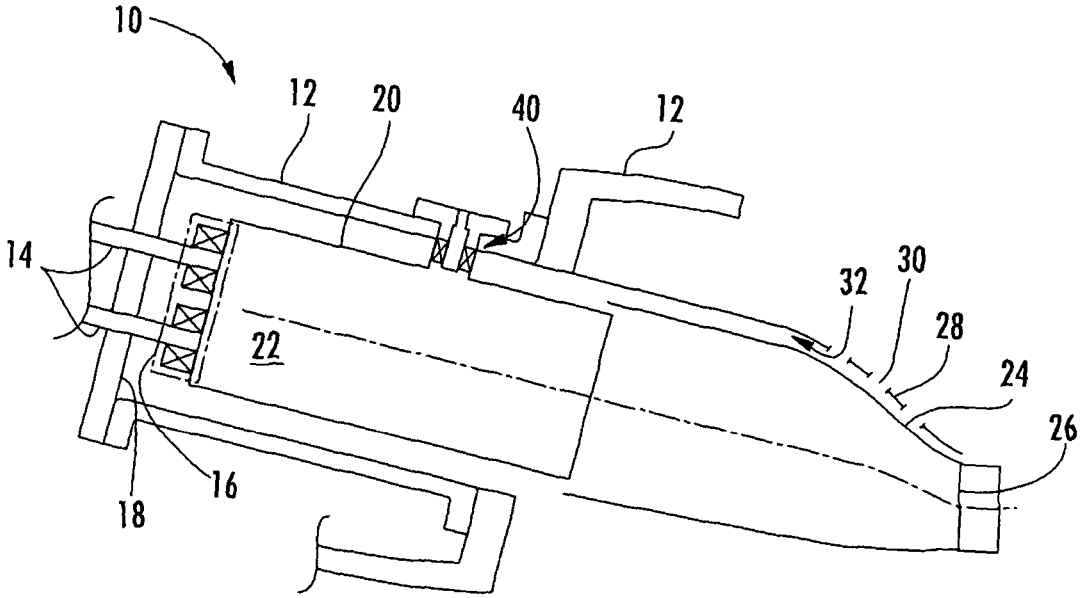
FIG. 3 is a simplified cross-section of a combustor according to a second embodiment of the present invention.
Figure 4:
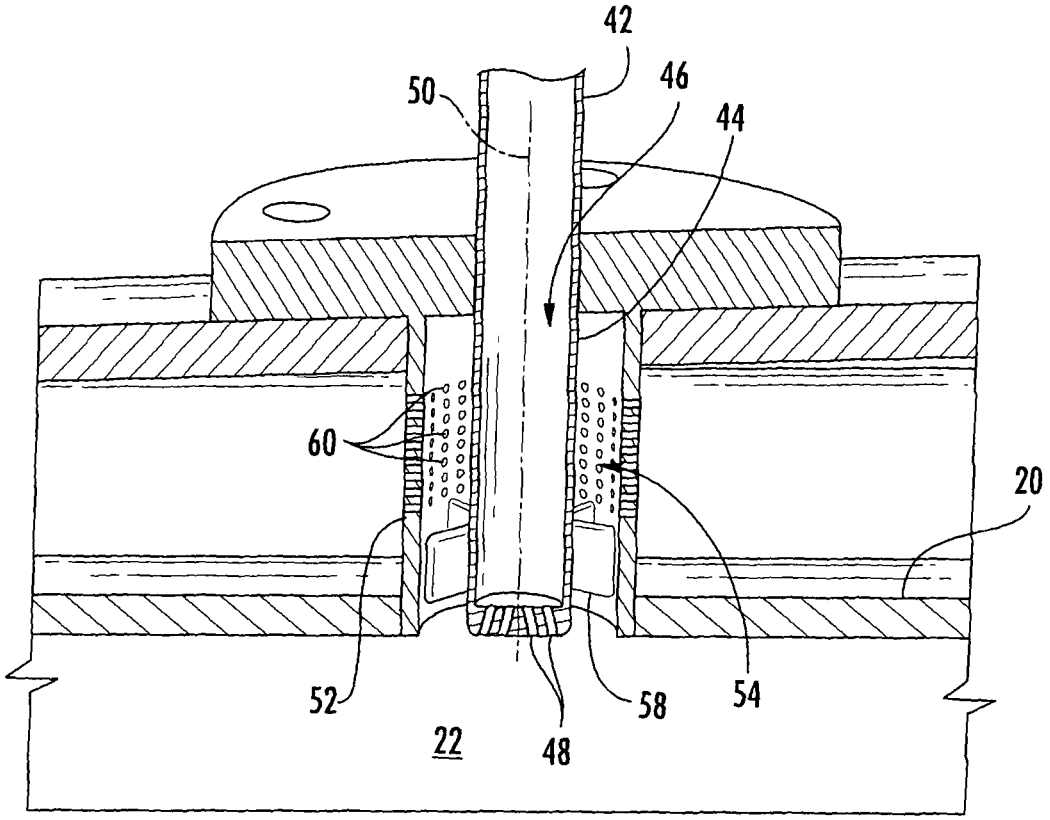
FIG. 4 is an enlarged view of an embodiment of a secondary nozzle shown in FIG. 3.

FIG. 3 provides a simplified cross-section of a second embodiment of the combustor 10, and FIG. 4 provides an enlarged view of the secondary nozzle 40 shown in FIG. 3. The combustor 10 again includes the casing 12, primary nozzles 14, cap 16, end cover 18, liner 20, combustion chamber 22, transition piece 24, and annular plenum 32 as previously described with respect to FIGS. 1 and 2. The secondary nozzles 40 are again circumferentially arranged around the combustion chamber 22 and aligned approximately perpendicular to each primary nozzle 14. In addition, the secondary nozzles 40 again connect to the fluid manifold 42 located outside of the combustor 10 so that the fluid manifold 42 may again supply fuel and/or diluent through the secondary nozzles 40 to the combustion chamber 22. However, in this particular embodiment, the secondary nozzles 40 provide fluid communication to the combustion chamber 22 through the liner 20.

As shown most clearly in FIG. 4, each secondary nozzle 40 again generally includes the center body 44, fluid passage 46, ports 48, annular passage 54, and swirler vanes 58 as previously described with respect to the embodiment shown in FIG. 2. However, in the particular embodiment shown in FIG. 4, the shroud 52 generally extends continuously from the casing 12 to the liner 20. In addition, the shroud 52 includes a plurality of apertures 60 that provides fluid communication through the shroud 52 to the annular passage 54. In this manner, compressed working fluid flowing through the annular plenum 32 may pass through the apertures 60 into the annular passage 54 and flow over the swirler vanes 58 into the combustion chamber 22.

Figure 5:
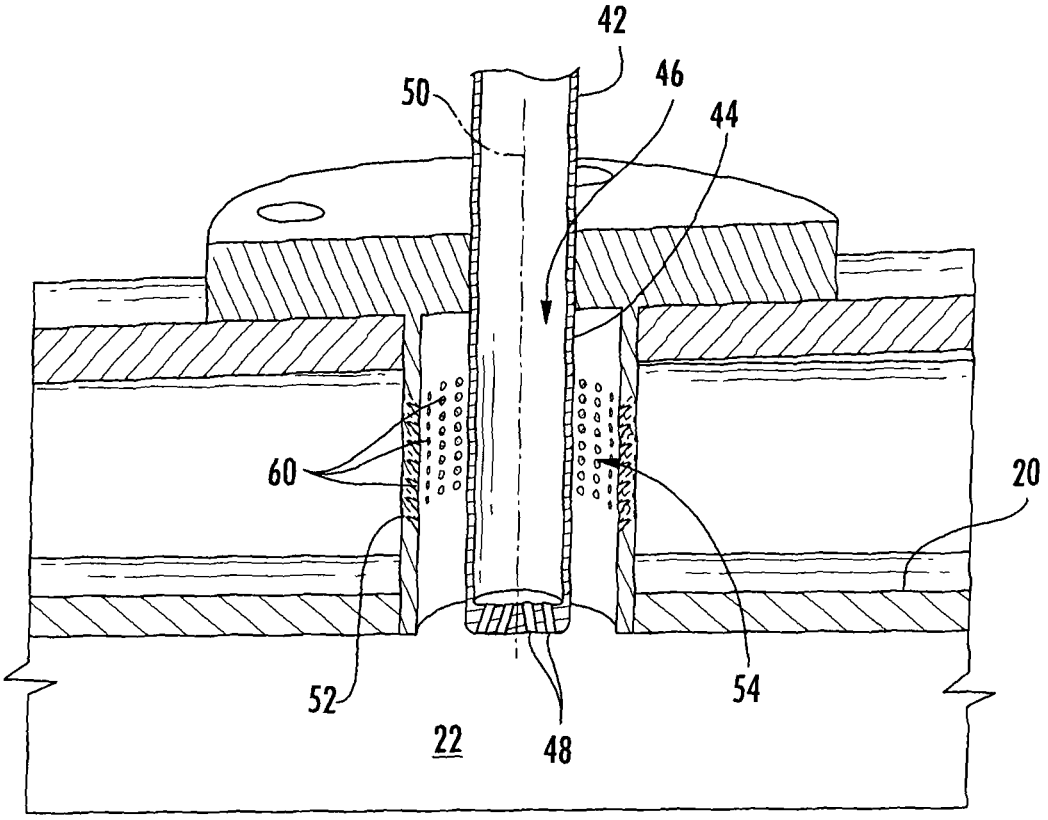
FIG. 5 is an enlarged view of an alternate embodiment of a secondary nozzle shown in FIG. 3.

FIG. 5 provides an enlarged view of an alternate embodiment of the secondary nozzle 40 shown in FIG. 3. In this particular embodiment, the swirler vanes 58 present in FIG. 4 have been removed, and the apertures 60 have been angled at least one of azimuthally or radially with respect to the axial centerline 50 of the fluid passage 46. In this manner, the angled apertures 60 impart a tangential swirl to the compressed working fluid flowing through the annular passage 54 and into the combustion chamber 22.

The various embodiments shown in FIGS. 1-5 provide a method for supplying fuel to the combustor 10. The method may include flowing a first fuel through the plurality of primary nozzles 14 radially disposed in the breech end of the combustor 10 and flowing a second fuel through the plurality of secondary nozzles 40 circumferentially arranged around and passing through at least one of the liner 20 or the transition piece 24. The first and second fuels may be the same fuel or different fuel, depending on the particular design and operational needs. Each secondary nozzle 40 generally includes the center body 44, the fluid passage 46 through the center body 44, the shroud 52 circumferentially surrounding at least a portion of the center body 44, and the annular passage 54 between the center body 44 and the shroud 52. In particular embodiments, the method may include flowing the first fuel approximately perpendicular to the second fuel. Alternately, or in addition, the method may include swirling the second fuel through the ports 48 and/or swirling the compressed working fluid flowing through the annular passage 54 into the combustion chamber 22.

It is anticipated that the various embodiments and methods described herein may provide one or more material and/or operational benefits over existing combustors. For example, the primary and secondary nozzles 14, 40 provide a staged injection of pre-mixed fuel-air mixtures into the combustion chamber 22. The staged injection of pre-mixed fuel-air mixtures may allow for more precise control of combustion gas temperatures during both high power operations as well during reduced power or turndown operations. A more precise control of combustion gas temperatures will in turn enhance the ability to reduce or control undesirable emissions produced across a wider range of combustor 10 operations. In addition, the arrangement of the secondary nozzles 40 circumferentially around the combustion chamber 22 allows for the fluid manifold 42 to be located outside of the combustor 10. As a result, leaks from the fluid manifold 42 outside of the combustor 10 may be easier to detect and repair, thus reducing and/or preventing harm caused by leaking fuel or diluent inside the combustor 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. a cap;

b. a liner extending downstream from the cap;

c. a transition piece extending downstream from the liner;

d. a combustion chamber downstream from the cap and at least partially defined by the cap and the liner;

e. a secondary nozzle secured to the liner, wherein the secondary nozzle comprises:

i. a center body that extends from a casing surrounding the combustor through;

ii. a fluid passage through the center body;

iii. a shroud circumferentially surrounding at least a portion of the center body and extending from the casing surrounding the combustor through the liner, wherein the shroud defines a plurality of apertures circumferentially spaced along the shroud, wherein the plurality of apertures provides fluid communication from an annular plenum defined between the liner and the casing through the shroud and into an annular passage defined between the center body and the shroud.

2. The combustor as in claim 1, further comprising a plurality of primary nozzles radially disposed in the cap.

3. The combustor as in claim 2, wherein each primary nozzle of the plurality of primary nozzles is aligned perpendicular to the secondary nozzle.

4. The combustor as in claim 1, further comprising a plurality of ports in the fluid passage, wherein the plurality of ports provides fluid communication between the center body and the combustion chamber.

5. The combustor as in claim 4, wherein each port of the plurality of ports is is angled with respect to an axial centerline of the fluid passage.

6. The combustor as in claim 1, further comprising a bellmouth opening around at least a portion of the shroud.

7. The combustor as in claim 1, wherein each aperture of the plurality of apertures is angled at least one of azimuthally or radially with respect to an axial centerline of the fluid passage.

8. The combustor as in claim 1, further comprising at least one swirler vane in the annular passage.

9. A method for supplying fuel to a combustor, comprising:

a. flowing a first fuel through a primary nozzle radially disposed in a breech end of the combustor; and b. flowing a second fuel through a secondary nozzle passing through a liner, wherein the liner is surrounded by a casing that at least partially surrounds the combustor thereby defining an annular plenum between the liner and the casing, wherein the secondary nozzle comprises:

i. a center body that extends from the casing through the liner;

ii. a fluid passage through the center body;

iii. a shroud circumferentially surrounding at least a portion of the center body and extending from the casing, through the annular plenum and through the liner, wherein the shroud defines a plurality of apertures circumferentially spaced along the shroud, wherein the plurality of apertures provides fluid communication from the annular plenum through the shroud into an annular passage defined between the center body and the shroud.

10. The method as in claim 9, further comprising flowing the first fuel perpendicular to the second fuel.

11. The method as in claim 9, further comprising swirling the second fuel flowing through the secondary nozzle.

* * * * *